US005286353A

United States Patent [19]

Wilkening

[11] Patent Number: 5,286,353

[45] Date of Patent: Feb. 15, 1994

[54] ELECTROLYSIS CELL AND METHOD FOR THE EXTRACTION OF ALUMINUM

[75] Inventor: Siegfried Wilkening, Alfter-Oedekoven, Fed. Rep. of Germany

[73] Assignee: VAW Aluminium A.G., Bonn, Fed. Rep. of Germany

[21] Appl. No.: 892,470

[22] Filed: Jun. 2, 1992

[30] Foreign Application Priority Data

Jun. 4, 1991 [DE] Fed. Rep. of Germany ..... 4118304

[51] Int. Cl.[5] ..... C25C 3/06; C25C 3/12; C25C 3/16

[52] U.S. Cl. ..... 204/67; 204/243 R; 204/244; 204/245; 204/279

[58] Field of Search ..... 204/243 R-247, 204/67, 294, 279

[56] References Cited

U.S. PATENT DOCUMENTS

| | | | |
|---|---|---|---|
| 2,859,160 | 11/1958 | Helling | 204/67 |
| 3,020,220 | 2/1962 | Gelling et al. | 204/67 |
| 3,322,658 | 5/1967 | Sem | 204/243 R X |
| 4,120,826 | 10/1978 | Ebel et al. | 252/463 |
| 4,166,100 | 8/1979 | Vorobiev et al. | 423/626 |
| 4,364,858 | 12/1982 | Goodboy | 252/463 |
| 4,376,690 | 3/1983 | Kugler | 204/243 R |
| 4,392,925 | 7/1983 | Alder et al. | 204/245 X |
| 4,405,433 | 9/1983 | Payne | 204/225 |
| 4,462,886 | 7/1984 | Kugler | 204/243 R X |
| 4,529,718 | 7/1985 | Dupin | 502/439 |
| 4,595,475 | 6/1986 | Pawlek et al. | 204/243 R |
| 4,596,637 | 6/1986 | Kozarek et al. | 204/243 R X |
| 4,919,771 | 4/1990 | Wilkening | 204/67 |

FOREIGN PATENT DOCUMENTS

| | | | |
|---|---|---|---|
| 0003598 | 8/1979 | European Pat. Off. | C25C 3/06 |
| 55164 | 6/1982 | European Pat. Off. | B01J 21/04 |
| 73703 | 3/1983 | European Pat. Off. | B01J 37/02 |
| 380300 | 8/1990 | European Pat. Off. | C25C 3/21 |
| 1008491 | 5/1957 | Fed. Rep. of Germany . | |
| 1200271 | 9/1963 | Fed. Rep. of Germany | C01F 7/44 |
| 1174517 | 7/1964 | Fed. Rep. of Germany . | |
| 2059946 | 6/1972 | Fed. Rep. of Germany | C01F 7/02 |
| 2726126 | 12/1977 | Fed. Rep. of Germany | B01J 21/04 |
| 2633599 | 2/1978 | Fed. Rep. of Germany | C01F 7/04 |
| 3128833 | 4/1982 | Fed. Rep. of Germany | B01J 23/04 |
| WO83/01465 | 4/1983 | Fed. Rep. of Germany | C25C 3/08 |
| 1028106 | 10/1987 | Fed. Rep. of Germany . | |
| 2826095 | 12/1990 | Fed. Rep. of Germany | C01F 7/44 |
| 1132770 | 3/1957 | France . | |
| 250521 | 10/1987 | German Democratic Rep. | C01F 7/30 |
| 274980 | 1/1990 | German Democratic Rep. | B01J 2/16 |
| 646202 | 11/1984 | Switzerland | C25B 11/12 |
| 1367925 | 9/1974 | United Kingdom | C01F 7/44 |
| 1575218 | 9/1980 | United Kingdom | C01F 7/46 |

OTHER PUBLICATIONS

Winnacker/Kuechler; Chemische Technologie (Chemical Technology), vol. 4, Fourth Edition, Carl Hanser Verlag Munich, 1986, Aluminum Chapter, pp. 252-282.

Grjotheim, K. and B. J. Welch: Aluminum Smelter Technology, Aluminium-Verlag, Duesseldorf, 1980.

Light Metals 1986, edited by R. E. Miller, Proceedings of the 115th AIME Annual Meeting, New Orleans, Mar. 1986, pp. 343-347, The Metall. Soc. Inc., Warrendale, Pa., USA.

(List continued on next page.)

*Primary Examiner*—Donald R. Valentine

[57] ABSTRACT

The present invention relates to a new electrolysis cell for the fusion electrolytic extraction of aluminum wherein the anode blocks are connected to one another using a compressed granulate packing. The invention also relates to a novel electrolytic cell wherein the cathode blocks are separated one from another and have sloped or curved upper surfaces allowing newly formed aluminum to drain into an underlying receptacle area.

32 Claims, 8 Drawing Sheets

OTHER PUBLICATIONS

Hall-Héroult Centennial, First Century of Aluminum Process Technology 1886-1986, edited by W. S. Peterson and R. E. Miller, presented at the 115th TMS Annual Meeting, New Orleans, Mar. 1986, The Metall. Soc. Inc., Warrendale, Pa., USA.

Wilkening, S.: Gewinnung von Aluminium durch Schmelzflusselektrolyse, Praxis der Naturwissenschaften (Extraction of Aluminum by Fusion Electrolysis, the Practice of the Natural Sciences) Chemie, vol. 35, No. 3, 1986, pp. 21-25.

Lange, G. and G. Wilde, Large Aluminum Cells with Continuous Prebaked Anodes, Extractive Metallurgy of Aluminum, vol. 2, edited by G. Gerrad, Interscience Publishers, New York, 1962, pp. 197-209.

Ginsberg, H. and S. Wilkening, Beitrag zur thermodynamischen und energetischen Betrachtung der Schmelzfluss-Reduktionelektrolyse des Alkuminiums (Contribution to the Thermodynamic and Energetic Analysis of the Fused-Mass Electrolysis of Aluminum), Part II, Metall, vol. 18 (1964), No. 9, pp. 9-19.

Winnacker, L. and L. Kuechler, Chemische Technologie (Chemical Technology), vol. 6 of Metallurgie, p. 194, Carl Hanser Verlag, Munich, 1973.

Abstract of JP-78-144,900.

Abstract of JP-80-25,131.

Abstract of JP-80-85,458.

Abstract of JP-80-121,914.

Abstract of JP-82-147,437.

Petzold and Ulbricht, Tonerde und Tonerdewerkstoffe (Springer-Verlag, New York) pp. 24-25.

ELECTROLYSIS CELL AND METHOD FOR THE EXTRACTION OF ALUMINUM

FIELD OF THE INVENTION

The present invention relates to the extraction of aluminum by electrolysis. More particularly, the invention is directed to an improved electrolysis cell for the extraction of aluminum according to the Hall-Héroult principle.

BACKGROUND OF THE INVENTION

Aluminum metal is prepared on an industrial scale by the Hall-Héroult aluminum electrolysis process.

In a typical arrangement an electrolysis cell is lined with carbon, which acts as the cathode. Iron or steel bars are embedded in the cathode lining to provide a path for current flow. The anodes are also of carbon and are gradually fed into the top of the cell because the anodes are continually consumed during electrolysis. Several cells may be connected in series.

For aluminum, the electrolyte used is typically cryolite ($Na_3AlF_6$) containing, when the $Al_2O_3$ is added by point feeders, 2 to 4% dissolved $Al_2O_3$. Other additives, such as $CaF_2$ (up to 6%) and $AlF_3$ (up to 12%), are added to obtain desirable electrochemical properties. The Hall-Héroult cell operates at temperatures of approximately 960° C. (1760° F.).

At the cathode of the aluminum cell, aluminum is reduced from an ionic state to a metallic state, through a series of complex reactions. The metallic (reduced) molten aluminum forms a molten pool in the bottom of the cell. Periodically, an amount of metal is drained or siphoned from the molten pool of aluminum metal at the bottom of the cell.

At the anode, oxygen is oxidized from its ionic state to oxygen gas. The oxygen gas in turn reacts with the carbon anode to form carbon dioxide gas, thereby gradually consuming the anode material. Two types of anodes are in use: prebaked and self-baking. Prebaked anodes are individual carbon blocks that are replaced one after another as they are consumed. Self-baking anodes, are made up of a carbon paste which is fed into the cell from above. As the anode descends in the cell it hardens and new carbon paste is fed continually into the top of the cell.

If impurities in the aluminum oxide raw material are carefully controlled, aluminum with a purity of 99.7% or higher may be produced.

The following references provide a general discussion of various aspects of fusion electrolysis extraction of aluminum, particularly the design and operation of electrolysis cells.

(1) Winnacker/Kuechler; Chemische Technologie (Chemical Technology), Vol. 4, Fourth Edition, Carl Hanser Verlag Munich, 1986, Aluminum Chapter, pp. 252-282

(2) Grjotheim, K. and B. J. Welch: Aluminum Smelter Technology, Aluminium-Verlag, Duesseldorf, 1980

(3) Light Metals 1986, edited by R. E. Miller, Proceedings of the 115th AIME Annual Meeting, New Orleans, March 1986, pp. 343-347, The Metall. Soc. Inc., Warrendale, Pa., USA (4) Hall-Héroult Centennial, First Century of Aluminum Process Technology 1886-1986, edited by W. S. Peterson and R. E. Miller, presented at the 115th TMS Annual Meeting, New Orleans, March 1986, The Metall. Soc. Inc., Warrendale, Pa., USA (5) Wilkening, S.: Gewinnung von Aluminium durch Schmelzflusselektrolyse, Praxis der Naturwissenschaften (Extraction of Aluminum by Fusion Electrolysis, the Practice of the Natural Sciences) Chemie, Vol. 35, No. 3, 1986, pp. 21-25.

To properly understand the process conditions of the present invention, the following theoretical relationships are set forth.

The energy theoretically required for the electrochemical reduction of $Al_2O_3$ using a carbon anode is approximately 6.5 kWh/kg of aluminum. The technically most advanced electrolysis plants have achieved specific energy consumption rates of about 13 kWh/kg of aluminum, but this still signifies a relatively low efficiency of about 50%. The theoretical amount of current required to deposit 1 kg of aluminum is 2.980 kAh/kg of aluminum. For the current yields of 93 to 95%, attainable under the most advantageous operating conditions, 3.17 kAh/kg of aluminum are required on the average. The specific consumption of electrical energy results from the product of current consumption and cell voltage:

$$E=(C\times U_Z)/\eta kWh/kg\ of\ Al$$

in which

C=2.98 kAh/kg of aluminum $\eta$=current yield $U_z$=cell voltage.

The cell voltage $U_Z$ is composed of the ohmic voltage drop of the cell $IR_Z$ and the polarization voltage $U_P$:

$$U_Z=I\times R_Z+U_p$$

I=electrolysis current.

The ohmic resistance of the electrolysis cell $R_Z$, which is responsible for the generation of heat, is distributed over the three essential regions of anode ($R_{An}$), electrolyte or electrolysis bath ($R_{Bath}$) and cathode ($R_{Ca}$), in which the amounts of heat, $E_{An}=I^2\times R_{An}$, $E_{Bath}=I^2\times R_{Bath}$ and $E_{Ca}=I^2\times R_{Ca}$, are generated. The electrolysis cell is operated in a thermal equilibrium and it has always been the goal of those in the art to minimize energy consumption and heat losses for economical reasons.

On the assumption that the specific energy consumption at a current efficiency of 94% (3.17 kAh/kg of aluminum) is 13 kWh/kg of aluminum, a cell voltage $U_Z$ of 4.1 volt is obtained, for which the following division can be designated:

$$U_{An}=0.4\ V=I\times R_{An}$$

$$U_{Ca}0.4\ V=I\times R_{Ca}$$

$$U_{An} = 0.4\ V = I \times R_{An}$$
$$U_{Ca} = 0.4\ V = I \times R_{Ca}$$

$$U_{Bath} = \frac{3.3\ V}{4.1\ V} = I \times R_{Bath} + U_p.$$

If a polarization voltage $U_P$ of about 1.7 V is deducted from $U_{Bath}$=3.3 V, approximately 1.6 V remains for the ohmic voltage drop ($I\times R_{bath}=U_{Bath}$). For a given cross-sectional area of the electrodes, that is, the cathode and the anode, the voltage drops depend, of course, on the current density.

As is provided for pursuant to the invention, it is possible to double the anode and cathode surfaces in an electrolysis cell while keeping the current strength I (amperage) unchanged. In this case, the ohmic voltage drop in the electrolyte decreases by half, that is, from at least 1.6 V to 0.8 V. With that, 0.8 V×3.17 kAh/kg of aluminum=2.5 kWh/kg of aluminum less energy would be produced in the form of joulean heat, without any disadvantageous effect on the interpolar distance between the anode and the cathode or on the current yield. One of the results of the decrease in the energy consumption pointed out here leads, for example, to the above-mentioned total consumption of 10 to 11 kWh/kg of aluminum.

In comparison to the present state of the art, the following improvements, are achieved with the inventive electrolysis cell. For discussion purposes the inventive process is classified into three general areas: (1) the process overall; (2) the anode region; and (3) the cathode region.

OBJECTS OF THE PRESENT INVENTION

A. The Overall Process

1. Reduction of Energy Consumption

A primary object of the invention is to provide an electrolysis cell for the extraction of aluminum according to the Hall-Héroult principle, which reduces the specific consumption of electrical energy by up to 20%. The most advanced, computer controlled aluminum electrolysis cells presently available, with current strengths of about 150 to 300 kA (kilo-amperes), can attain a specific consumption of electric energy of about 13 kWh/kg (kilowatt-hours per kilogram) of aluminum produced. The electrolysis cells of the present invention provide for a reduced energy consumption of 10 to 11 kWh/kg of aluminum.

2. Decreasing Heat Generation in Electrolyte

It is an important object of the present invention to decrease the heat generated in the electrolyte by reducing current densities. The anodic current densities customary in known high-current cells (>150 kA) lie between 0.65 and 0.85 A/cm$^2$ (amperes per square centimeter). For earlier, smaller electrolysis cells, anodic current densities of more than 0.85 A/cm$^2$ were employed. For economic reasons and to maintain the required heat balance, current densities of less than 0.60 A/cm$^2$ have not been employed.

It is an object of the inventive electrolysis cell to decrease the current density in the electrolysis bath, without, however, limiting the production of metal of the electrolysis cell, which is proportional to the current strength I. Pursuant to the present invention, this is accomplished in part by increasing the surface area of the active, opposing anode and cathode by selecting an optimized spatial orientation for the anode and cathode in such a way that the space-time yield is not reduced. In an embodiment of the electrolysis cell described below, current densities of less than 0.6 A/cm$^2$ are preferably realized.

3. Decreasing Heat Losses Over the Side Walls of the Cell

Another object of the present invention is to decrease heat losses over the side edges of the electrolysis cell. Electrolysis cells of older types of construction are attended to largely from the direction of the longitudinal sides. At periodic intervals of several hours, aluminum oxide is supplied from the side to the electrolyte bath by breaking in the covering crust together with the aluminum oxide lying above this crust. Prior to the present invention, for modern electrolysis cells with high current strengths (>150 kA), the metered added oxide is transferred to the central zone of the electrolysis cell, for example, to the whole of the central channel or to advantageous points between the two conventional rows of anode blocks. For the metered addition of oxide, computer-controlled, automatically operated fracturing and charging apparatuses are employed, which maintain a relatively low oxide concentration of about 1 to 4% by weight in the electrolyte according to a specified program.

Until the present invention there has not been a resistant lining material for the side rim of the electrolysis basin. For this reason, the formation of a crust of solidified electrolyte material is required for the side rim and is ensured by the adequate withdrawal of heat through the side walls of the electrolysis vat. Consequently, the heat losses through the side walls of modern, centrally operated electrolysis cells can amount to 30% of the total heat losses.

To limit this high lateral dissipation of heat, the present invention provides for the feeding of aluminum oxide along the outer edges of the inventive electrolysis cell. The cell may be provided with either permanently installed or movable breaking devices, ("bats") with which the lateral covering crusts are broken in smaller or larger sections, or also punctually with the help of a point-wise metering apparatus, which can be programmed to move along the whole of the side front. The heat conducted to the edge by the liquid aluminum and the electrolyte melt, is utilized for heating and dissolving the oxide that has been knocked in or added in a metered fashion. By these means, the heat-insulating edge crust is effectively reinforced and protected against excessively rapid dissolution.

In addition, in one embodiment of the present invention the aluminum, which has a high thermal conductivity, is kept away from the side wall of the cell by a heat and aluminum resistant side base, the height of which is made to fit the aluminum layer on the cathode bottom. The resistant side base may, for instance, be constructed of carbon material.

There are three main routes by which heat is conducted to the side walls of the cell (where it can be lost). These routes are via the electrolyte bath, via the steel collector bars which protrude from the cathode and contact the side, and via the aluminum layer. The aluminum layer provides the main conduit for heat loss through the sides of the cell. The present invention, which allows the aluminum layer to be segregated from both the electrolyte layer and the $AL_2O_3$ feed mechanism, facilitates the lateral insulation of this layer by allowing the use of the resistant side base or by allowing the insulative portion of the edge crust to be retained.

4. Decreasing Heat Loss Through Waste Gases

Another object of the present invention is to decrease the heat lost by waste gases by about 40%. It is, for example, customary to exhaust 5,000 m$^3$ per hour of waste gas from a modern, sealed 200 kA electrolysis cell. This corresponds to a specific exhaust-gas volume of 80 m$^3$/kg of aluminum, if it is assumed that the cell has a current yield of 93% and, with that, an hourly aluminum production of 62.5 kg. The theoretically produced anode gas volume ($CO_2+CO$) constitutes only approximately one hundredth of that volume, i.e., about 0.8 $m^3$/kg of aluminum.

Because the electrolysis process and apparatus of the present invention is designed to have fewer leaks and the housing need be opened only relatively infrequently through a small shutter (once daily for the aspiration of metal), the volume of the waste gas can be reduced by more than one half without danger of fluorine emission Cooling of the electrolysis cell by the removal of aspirated gas is substantially avoided.

With the aspiration of waste gas, which contains large amounts of infiltrated air, considerable amounts of heat are dissipated from the space over the total anode surface, as is shown by the following rough calculation. With waste gases of a caloric content of $2.83\times10^{-4}$ kWh/(kg×K), a gas density of 0.83 kg/$m^3$, a temperature difference of 90K between 105° C. (the outlet temperature at the furnace) and 15° C. (average outside temperature) and the aforementioned 80 $m^3$ /kg of aluminium, approximately 2.5 kWh/kg of aluminum results. For the electrolysis cell of the present invention, this amount is reduced by about 1 kWh/kg of aluminum. The 50% reduction in the volume of waste gas permits the pipelines, purification facilities and the exhaust gates for the waste gases of the furnace to be designed correspondingly smaller and, therefore, less expensively.

5. Decreasing Bubble Resistance

Yet another object of the present invention is to decrease the bubble resistance and the anode interfacial potential. The carbon anode is combusted to an anode gas by the oxygen that is released electrolytically at the anode. Aside from CO, the anode gas consists predominantly of $CO_2$. This anode gas collects closely below the anode blocks in the form of many small bubbles and migrates in the electrolyte melt toward the edges of the block, where it rises and escapes. Because they persist under the rough anode interface and displace the electrolyte, the gas bubbles cause so-called "bubble resistance", which causes an increased ohmic resistance for the electrolysis current. Pursuant to the invention, this bubble resistance is reduced by about 0.1 V (approximately 0.3 kWh/kg of aluminum) based on the voltage balance of the electrolysis cell by using inclined anode surfaces that allow more rapid removal of gas from the electrolyte layer, lower anodic current densities and an oxide concentration of about 4% by weight. It has been proven experimentally that the anode effect, which occurs due to $Al_2O_3$ depletion in the cryolite melt, is less at inclined anode surfaces with smaller oxide concentrations and lower overvoltage in the early starting phase than at horizontal anode surfaces. (See, La Metallurgia Italiana, N.2, 1965, R. Piontelli, B. Mazza, P. Pedeferri, "Ricerche Sui Fehomehi Anodici Relle Celli per Alluminio, p.63.)

6. Decreasing Anode Consumption

Another object of the present invention is to decrease the anode consumption by up to 8% (relative). In this connection, it is first necessary to clarify the question of the initial value, to which the decrease in the specific anode consumption refers, since this depends on a series of factors. A specific anode consumption of 0.42 kg of carbon per kg of aluminum is regarded as good and peak consumptions of 0.40 kg of carbon per kg of aluminum are attained under favorable conditions. Due to the design-induced decrease in air oxidation of the anode blocks of the inventive cell, values of less than 0.40 kg of carbon per kg of aluminum are attained for the specific anode consumption.

Note that, due to the design of the electrical contacts between anode blocks, the gas spaces immediately above the electrolysis region are protected from air infiltration, thus minimizing oxidation in this high temperature reactive zone. These favorable conditions are maintained when the top of the cell is opened to service the anodes.

7. Decreasing Fluorine Emission

Another object of the present invention is to provide an electrolysis cell having reduced fluorine emission. Dust-and fluorine containing gas, which is aspirated from the electrolysis cells, is supplied to a dry gas purification plant, in which the gaseous fluorine is converted to HF and absorbed on aluminum oxide and the fluorine-containing dust particles are precipitated in filter plants. The fluorine emission depends, in part, on the efficiency of the waste gas purification facility. For various operating processes, the sheet metal housings of the present invention, in which the electrolysis cells are encased, must be partially opened. Additional fluorine emissions arise during the times that these housings are open.

In the case of electrolysis cells with prebaked, discontinuous anode blocks, the housings are generally opened daily to replace an anode block. When the anode block is removed it tends to smoke relatively strongly until it has cooled down to below the glowing temperature. After it is removed it briefly leaves behind an uncovered spot of fused electrolyte with increased vaporization of fluoride.

In the case of the known electrolysis cells with prebaked, continuous anode blocks, the gates on the longitudinal side of the housing must be opened for breaking the crust and charging oxide. In addition, in a relatively tedious procedure with the side gates open, the anode rods of all blocks (four rods per block) must be periodically detached from the lower row of stubs and fastened to the subsequent upper row. The lower row of contact stubs is subsequently pulled. The gas exhaust system is also not effective when a layer of new anode blocks must be deposited.

In view of the need to protect the environment effectively, the time during which the electrolysis furnace housing is opened as described may be minimized by the inventive electrolysis cell.

Carbon anodes contain sulfur and evolve sulfur dioxide. In view of environmental concerns, when anodes with high sulfur content are used, the resulting sulfur dioxide must also be removed from the waste gas. Low waste-gas volume is an advantage in desulfurization. The reduced waste gas volume of the inventive electrolysis cell is discussed above.

8. Reducing Impurities in the Virgin Metal

Another object of the present invention is to reduce impurities in the virgin metal. The inventive electrolysis cell utilizes the advantage of the prebaked, continuous anode. It is known that metals of higher purity can be attained with such an electrode than with a prebaked, discontinuous anode.

The higher degree of impurity resulting from the latter method is largely attributable to the fact that the steel stubs of the anode blocks in the electrolysis cell are subject to more severe corrosion, and the anode butts (residues) with thick covering layers of bath material and oxide must be processed and recycled. The abrasion of iron and rust in the breaking, grinding, conveying and storage equipment of the processing and recycling plants causes, for example, a distinct increase in the iron content of the aluminum subsequently produced.

In relation to the known anode system with prebaked, continuous anode blocks, the inventive method avoids the use of steel side stubs and permits up-to-date current strengths of more than 150 kA.

B. Improvements in the Anode Region

1. Constant Voltage Drops and Constant Current Strengths in Individual Anode Blocks An essential component of the inventive electrolyte cell is an anode system with prebaked, continuous anode blocks, which is preferred for electrolysis cells with a total capacity of more than 150 kA. Uniform, short current paths between the current connections and the electrolyte bath are provided for the individual anode blocks of this system. Equal voltage drops and equal current densities result from this for all anode blocks.

Compared to an anode system with prebaked, discontinuous anode blocks, the homogeneous current distribution of the inventive anode systems signifies an enormous advantage in providing a quiet, steady course of electrolysis, a high current yield and a low specific energy consumption. In an electrolysis cell with a discontinuous anode system, at any given moment all anode blocks are at a different stage of consumption, which necessarily entails a great variation in the individual voltage drops and current strengths in the individual blocks. Consequently, there are always two groups of anode blocks in the discontinuous anode system, of which the one is below and the other is above the nominal current strength in its current consumption and current density.

During an anode block life, the current strength in the block increases from zero, when exchanging the anode block, to a maximum value shortly before taking the residue out. Another drawback is that in the typical system, one to two days pass after an anode block is exchanged, before the new block has attained the average operating temperature and participates fully in the electrolysis. The disadvantages just shown increase with the trend towards larger electrolysis cell units and anode block units. These disadvantages are minimized by the present continuous anode block system.

2. Increasing the Life of Anode Blocks

In anode systems with prebaked, discontinuous anode blocks, it is generally customary to exchange one anode block daily. The remainder of an anode block (about 20 to 30% of the initial weight) is removed and replaced with a new block. Very large electrolysis cells with a current strength of more than 200 kA, may require exchange of two anode blocks or a pair of anode blocks daily. This exchange of anode blocks disturbs the electrolysis process appreciably and leads to the previously discussed nonuniformity in the anodic current density distribution. The supplementation of anode blocks according to the inventive method does not affect the actual electrolysis process at all. Only about every 7th to 10th week is it necessary to place a new layer of anode blocks on the stack of anode blocks in the electrolysis cell of the invention.

3. Need for Only one Anode Block Row per Electrolysis Cell

In modern high-current or modernized electrolysis cells, apparently due to design constraints, the anode blocks are consistently arranged in two longitudinal rows. In the inventive electrolysis cell, the anode blocks extend over the entire width of the cross sectional area in the electrolysis vat that is intended for the anode. Thus, the anode blocks of the present invention lack two front block surfaces along the center channel. Experience has shown that these center channel surfaces are exposed more severely to oxidation by air and $CO_2$ and increased erosion.

4. Lack of Residual Anodes

As discussed above, significant process technology advantages and operational savings are achieved with the present invention because there are no longer any anode residues (butts), because, due to the continuous anode design, the entire initial anode mass is consumed (while further anode mass is periodically added as the anode is consumed). It is not necessary to strip away the covering layer of solidified electrolyte melt and aluminum oxide from the residual anodes and then clean them as required in prior systems. Quantitatively, the bath material, which must be cleared away, comminuted and recycled into the electrolysis cell, constitutes about 20% of the initial weight of the anode block. Likewise, the residual weight of the anodes leaving the electrolysis cell constitutes 20–30% of their starting weights, depending on the mode of operation. It can easily be seen that this recycling of anode residues within the plant necessary with prior systems, leads to an additional permanent burden on the anode factory in the three main steps of the process, namely preparing, molding and baking, of 20–30%, compared to the basic, process-consumed amount of anode blocks (which is all that is needed using the inventive method). In addition, there is the further disadvantage that the anode residues contain fluorine; to fulfill the emission conditions, a waste gas purification system for the fluorine-laden furnace waste gases must be connected downstream from the anode block ring-type basking furnace.

Between the electrolysis operation (the "pot room") and the anode plant of an aluminum smelter, the so-called "rodding shop" is responsible for the task of recovering residual anodes from the electrolysis, permitting them to cool off in a storage shed, cleaning them, separating the anode residues and the cast iron thimbles from the anode rods and preparing them for reuse. In addition, new anode blocks are connected in the rodding shop with the anode rods, using cast or rammed steel stubs and made ready for use in the electrolysis operation.

The present invention makes this part of the smelter superfluous.

5. No Anode Block Preparation

In prior methods, the prebaked, continuous anodes required stub holes to be drilled in them and steel current contact bolts to be firmly inserted into these holes with a suitable carbon composition. This preparatory work is not required for the inventive cell, because the current is supplied by contacting without the need for stubs, as is described in greater detail below.

According to the state of the art, the bottom of the continuously used anode blocks is provided in the preparation station with a connecting layer of a gluing paste or adhesive cement composition, which normally is prepared from petroleum coke and electrode pitch. The gluing paste is applied as an approximately 2 cm thick layer in a hot, flowable state on the preheated anode block connecting surface, i.e., on the under side of the anode block, which has been turned to face upwards for the purpose.

The necessity for applying the gluing paste in this manner is eliminated by the present invention. Accordingly, the need for a preparation facility and heating energy for preheating the anode blocks and melting the gluing paste is eliminated.

The design and the mode of operation of the inventive electrolysis cell permits application of the gluing paste or adhesive cement composition as a granulate on the upper sides of the warm anode blocks in the electrolysis cell. Immediately afterwards, cold, preheated or, preferably, anode blocks that are still warm from the baking process are placed on the granular gluing composition. If necessary, the latter type of blocks must be freed from the packing material of the baking furnace, but require no other special preparation. It is evident that, the improvements in the anode block arrangement described herein allow for less thermal energy, lower investment cost and less effort.

C. Improvements in the Cathode Region

1. No Effect of the Magnetic Field on the Aluminum Bath

The present anode system having prebaked, continuous anode blocks ensures that the underside of the anode blocks, which is immersed in the electrolyte melt, may be not only flat in the horizontal direction, as is generally customary, but alternatively wedge-shaped or arched. If the aluminum bath available does not have a plane surface as effective cathode, the interfacial shape of the anode block in the molten electrolyte adapts to the shape of the opposite cathode surface.

In a preferred embodiment of the present inventive electrolysis cell, and as described in further detail below, the bottom of the cell, which is built up from carbon cathode blocks, is roof-shaped or half barrel-shaped, corresponding to the number of anode blocks. Viewed in cross section, the cathode blocks have, for example, the shape of a triangle, semicircle or similar geometric structure. Below the cathode blocks, which lie transversely and parallel to one another in the electrolysis cell, a flat cavity or collecting space for the liquid aluminum is disposed. Furthermore, a channel is provided between the lower edges of the parallel cathode blocks as connection between the flat bottom space for the liquid aluminum and the space above this for the electrolyte melt. The aluminum is deposited by the electrolysis current on the inclined surfaces of the cathode blocks and flows into the shallow bottom space below the cathode blocks.

The large magnetic field problem of conventional, high-current electrolysis cells is based on the fact that the layer of liquid aluminum on the cathodically connected carbon bottom through which the current is flowing interacts with the magnetic fields which surround the current conductors about the electrolysis cell. The magnetic field forces which are exerted on the liquid aluminum layer displace the aluminum and bring about metal arching and rotation (i.e., causes movement in the aluminum layer, which can disrupt the efficient operation of the cell). Accordingly, for the design, construction and operation of high-current cells, particularly of cells with a current strength of more than 100 kA, it is, therefore, indispensable to ensure that, through extensive magnetic field calculations that positioning of the conductor bars (leads) is optimized to minimize metal arching and movement. This is a prerequisite to allow the economic production of metal in the electrolysis cell.

In the inventive electrolysis cell, the magnetic field effect is eliminated because the electrolysis current, entering the cathode, does not have to cross an aluminum bath. Rather, the collecting basin for the liquid aluminum is located outside the current passage path, namely below the cathode blocks. Fundamental advantages arise out of this arrangement and will be explained in greater detail below.

2. Reduced Constraints on the Positioning of Current Conductors

In a typical plant, a not inconsiderable amount of conductive aluminum metal of, for example, the order of 50 tons per 1,000 tons annual capacity is invested in the outer region of the electrolysis cell.

If, as the invention intends, it is not necessary to make allowances for a magnetic field compensation within the electrolysis cell in accordance with model calculations and operational experience, the shortest and most rational paths can be selected for the current connections between the electrolysis cells, which are connected in series, and for the current distribution on anode and cathode beams. The risers (which lead current to the anode bus bar from which the anodes are suspended) are disposed in the middle field of the electrolysis cells for reasons of magnetic field compensation. Generally, the risers are an impediment to the operation of the electrolysis cells, but in the present arrangement they can be shifted to the end of the inventive electrolysis cells, where they do not interfere with operations. The ability to arrange the conductor rails independently of the magnetic field, saves up to about 20% of the usage of conductive aluminum. In addition, a somewhat lower power loss can be expected in the main feed line.

3. Elimination of Danger of Dissolving Cathode Iron in the Aluminum and a Longer Service Life for the Lining of the Electrolysis Cells Conventionally, the steel bars for supplying current to the carbon bottom serving as cathode are embedded in grooves of the carbon cathode blocks on the underside of the carbon bottom. However, it frequently happens that the carbon bottom, especially with increasing age of the cells, develops cracks, through which the supernatant, low viscosity aluminum penetrates down to the cathode steel bars and etches or dissolves the steel by forming an alloy. One of the most frequent causes for switching off and shutting down the electrolysis cells is the dissolution of iron from the cathode bars into the aluminum bath.

Pursuant to the invention, this breakdown cause may be avoided by positioning the aluminum bath below the cathode blocks (see item C 1) and embedding the steel bars from above in the cathode blocks.

Pursuant to the invention, the bottom of the electrolysis cell which carries the aluminum layer, does not carry current and is exposed to less of the electrolyte (cryolite melt). It is, therefore, exposed to far less chemical and mechanical wear and destructive sodium infiltration, which is accompanied by a volume expansion and conversion process, than the known cathode bottom. The construction of the cathode and the cell bottom, which are separate pursuant to the invention, also results in a prolongation of the durability and service life of the electrolysis cell lining. This results in a reduction in costs and an easing of the serious disposal problem for the consumed cell lining materials.

If sodium-resistant, graphite cathode blocks having a higher thermal conductivity of 80 to 100 W/m/°K are used in the inventive electrolysis cell, less heat is carried away by these blocks into the bottom insulation. The cathode blocks are subject to less wear, because metal is not flowing over them and the erosive effect of aluminum oxide sludge is removed. The voltage drop in the cathode blocks and in their supply lines is, moreover, distinctly lower than with conventional cathode blocks.

In the preceding sections A, B and C, the characteristic advantages of the inventive electrolysis cell were outlined and compared with the known characteristics of different types of electrolysis cells using prebaked anode blocks. As discussed above, a continuously operated anode system is required for the solution in principle of the detailed tasks within the scope of the inventive electrolysis cell. In theory, a continuous anode system with prebaked carbon blocks is known, the mode of functioning and technical state of which is explained in the following publications:

(6) Lange, G. and G. Wilde, Large Aluminum Cells with Continuous Prebaked Anodes, Extractive Metallurgy of Aluminum, Vol. 2, edited by G. Gerrads, Interscience Publishers, New York, 1962, pp. 197-209

(7) Ginsberg, H. and S. Wilkening, Beitrag zur thermodynamischen und energetischen Betrachtung der Schmelzflusselektrolyse des Aluminiums (Contribution to the Thermodynamic and Energetic Analysis of the Fused-Mass Electrolysis of Aluminum), part II, Metall, Vol. 18 (1964), No. 9, pp. 908-918

(8) Winnacker, L. and L. Kuechler, Chemische Technologie (Chemical Technology), Vol. 6 of Metallurgie, pg. 194, Carl Hanser Verlag, Munich, 1973

The anode system described in the literature cited above cannot be used to achieve the main objectives of the present invention, of extremely low energy consumption, minimal contamination of the environment, a high degree of automation and elimination of physical working cycles (e.g., cell openings) that may be harmful to health. The prebaked anode blocks of the known, continuous anode system have laterally inserted contact stubs with detachable anode rods. The rehanging and re-securing of the anode rods as well as the pulling of the contact stubs is associated with considerable expenditure of manual work. The lateral space of the electrolysis cell is reserved for these manipulations and cannot be utilized for other facilities, such a automatic devices for supplying oxide. The side gates of the electrolysis cell must be opened for such operating processes. Moreover, current is introduced into the anode blocks over contact stubs, which are disposed on the front side and in relatively high steps. This results in long current paths in the anode blocks. The long current paths result in an increased voltage drop in the anode, which is almost 0.5 V higher on the average than in the anode blocks used discontinuously. For electrolysis cells with current strengths of 180 kA and higher, the anode blocks would even have to be longer by about a third than was previously customary, so that, as a result, the voltage difference in the anode blocks between current entry and exit would be significantly worse still.

Although oversize carbon blocks are also used in the inventive electrolysis cell, their length goes considerably beyond the previously known measure and their manufacturing process is particularly rational and efficient. The electrolysis current is supplied to them not by the known method, that is, over steel contact bolts inserted in holes, but practically infinitely displaceably over a package of compressed graphite granules along both longitudinal sides of the individual anode blocks. According to the known procedure, the anode blocks, which are periodically put one on top of the other, are connected to one another by a cokable glue or adhesive cement composition, which is previously applied to the underside of the upper block. Pursuant to the invention, the required amount of adhesive cement composition and thus the thickness of the adhesive layer may be reduced from about 1 to 2 cm to half this amount. Moreover, as explained above, the adhesive cement composition is applied in the form of a granulate locally, in the electrolysis cell, to place hot anode blocks at a temperature of 200° to 250° C. on the adhesive cement. As can be seen from the following description, the coking conditions of the adhesive cement layer are also improved significantly in order to attain a higher density and strength.

In European patent application EP A 0 380 300, an electrolysis cell with a continuous anode was proposed. This proposal differs from the inventive electrolysis cell at least because the current is supplied directly to the anode blocks over flat-surfaced, stiff clamping devices with horizontal contact pressure, and not over graphite packages or granular coke packages, which are pressed together without the use of a binder. Moreover, the proposal of the EP-A 0 380 300 has significantly different characteristics with respect to the arrangement, mounting and replenishing the anode block stack.

SUMMARY OF THE INVENTION

The present invention relates to an electrolysis cell for the fusion electrolytic extraction of aluminum comprising:

a) a cell housing;

b) plurality of anode blocks having longitudinal and front sides and a lower surface;

c) cross connecting means for physically connecting said blocks along said longitudinal sides and providing a packing receiving channel therebetween, each said cross-connecting means attached to an upper part of the cell housing;

d) granulate packing of carbon-containing material packed into said channels, said packing and cross connecting means physically and electrically joining the anode blocks;

e) a plurality of cathode blocks, each said cathode block having an upper surface facing the lower surface of a corresponding anode block; and f) means for maintaining an intervening space between the facing surfaces of said anode block and said cathode block.

The invention also relates to an electrolysis cell for the fusion electrolytic extraction of aluminum comprising:

a) a cell housing;

b) a plurality of anode blocks having longitudinal and front sides and a lower surface;

c) cross connecting means for physically connecting said blocks;

d) a plurality of cathode blocks, each said cathode block having an upper surface opposing the lower surface of a corresponding anode block, wherein the cathode blocks are disposed at a distance from one another and at a distance from the bottom lining of the cell, the space so formed beneath the cathode blocks providing a collecting basin for aluminum, and said cathode block upper surfaces being sloped and disposed facing the anode blocks such that aluminum formed during electrolysis drains to the collecting basin;

e) means of disposing said cathode blocks relative to one another and of maintaining a space between said cathode blocks and the cell bottom; and f) means for maintaining an intervening space between the opposing surfaces of said anode block and said cathode block.

BRIEF DESCRIPTION OF THE DRAWINGS

The essential characteristics of the inventive electrolysis cell are shown diagrammatically in FIGS. 1 to 8. The simplified are to be taken as embodiments.

DETAILED DESCRIPTION OF THE INVENTION

Figure 3:
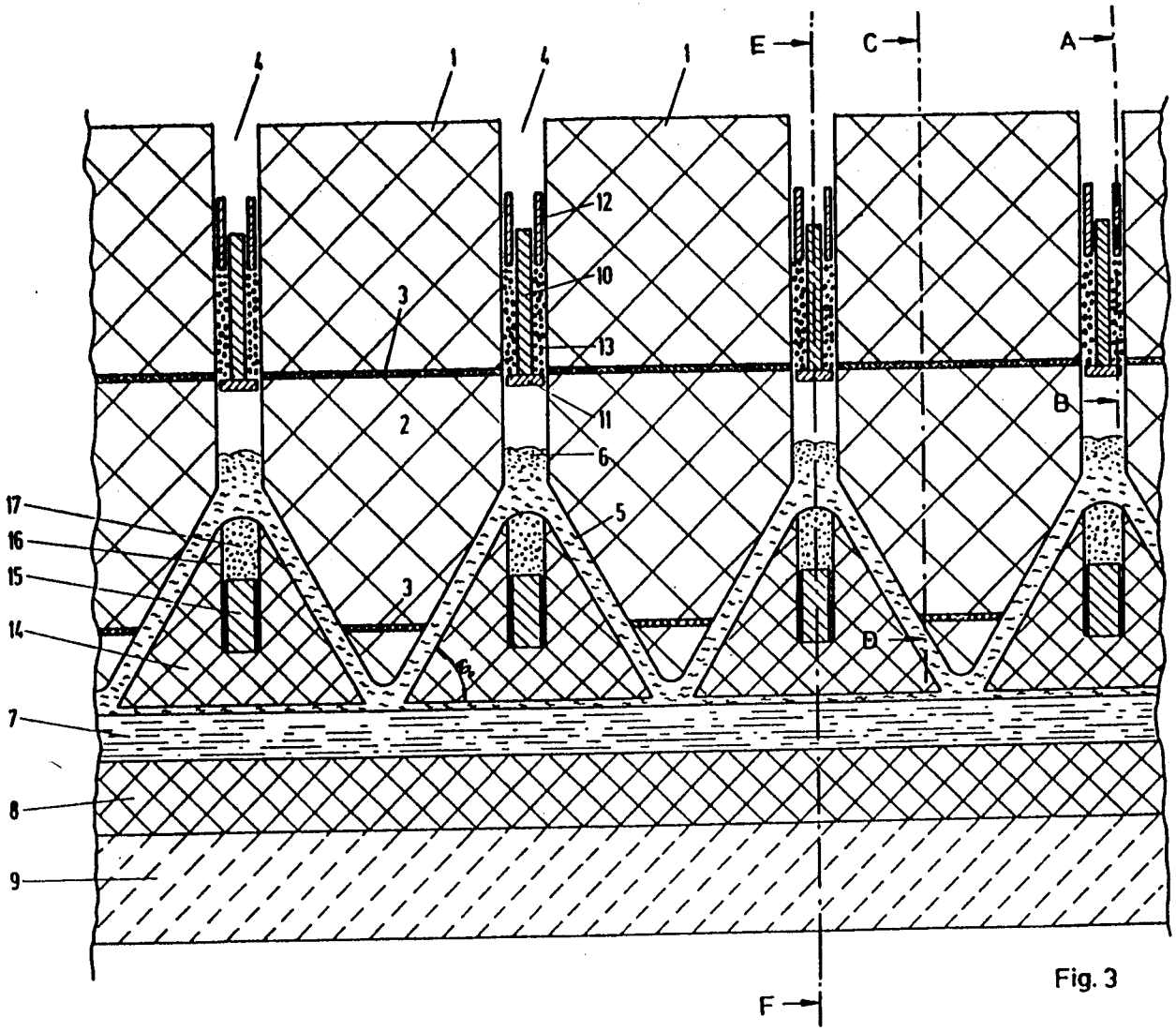
FIG. 3 is similar to the drawing section of FIGS. 1 and 2, however, with angular relationships of 60° in the relative positions of anode and cathode.

The most important measures taken to realize the inventive objectives can be described with the greatest degree of inclusion by means of the sectional representation of FIG. 3.

The anode blocks 1 and 2 extend in continuous length at right angles to the electrolysis cell axis and are joined together by the adhesive cement layer 3. The adhesive cement is preferably a pitch-bonded coke-based gluing paste, but other adhesives, such as resin-bonded glues, may also be used. In lane 4 between two adjacent anode block packages, a cross connector 10 of flat-bar steel with flange 11 is disposed. The gap between the cross connector 10 and the longitudinal side of the anode block is filled with a coarse graphite granulation 3, which is compressed by the steel compression girder 12.

In one embodiment, the cross connector is trapezoidal in cross-section with the enlarged end adjacent to the flange.

The current-supplying device, thus, includes contact elements 10, 11 and 12 and the compressed graphite granulation 13. Instead of electrographite grains (which can be crushed and screened material derived from graphite electrodes or blocks), grain fractions of petroleum coke, pitch coke or broken anode block residues can also be used. However, these latter carbon materials have a 3- to 6-fold higher specific electrical resistance. A granular mixture of electrographite and coke can also be used. The harder coke granules increase the friction between the granular packing and the anode block and, under some circumstances, may be necessary for this reason in order to prevent the anode block package slipping through. With the contact elements described, electrolysis current is supplied to both sides of the anode blocks 1 and 2 over the whole of their length with a low voltage drop. Moreover, the contact elements closes off the channel 4 over its entire length, so that electrolyte vapors and anode gases cannot emerge from the bottom to the top through the channel 4. At the same time, the lower hot side faces of the anode block are protected against access by air and combustion in air from above. The specific pressure on the graphite granulation is of the order of 150 to 300 $N/cm^2$. For the step 11, the underside of which is exposed to elevated temperatures and increased corrosion, a steel or other metal alloy is used, which is highly resistant to heat and corrosion. To maintain short current paths and low voltage drops, the position of the current supplying equipment should be brought as close as possible to the bath crust 6.

Figure 1:
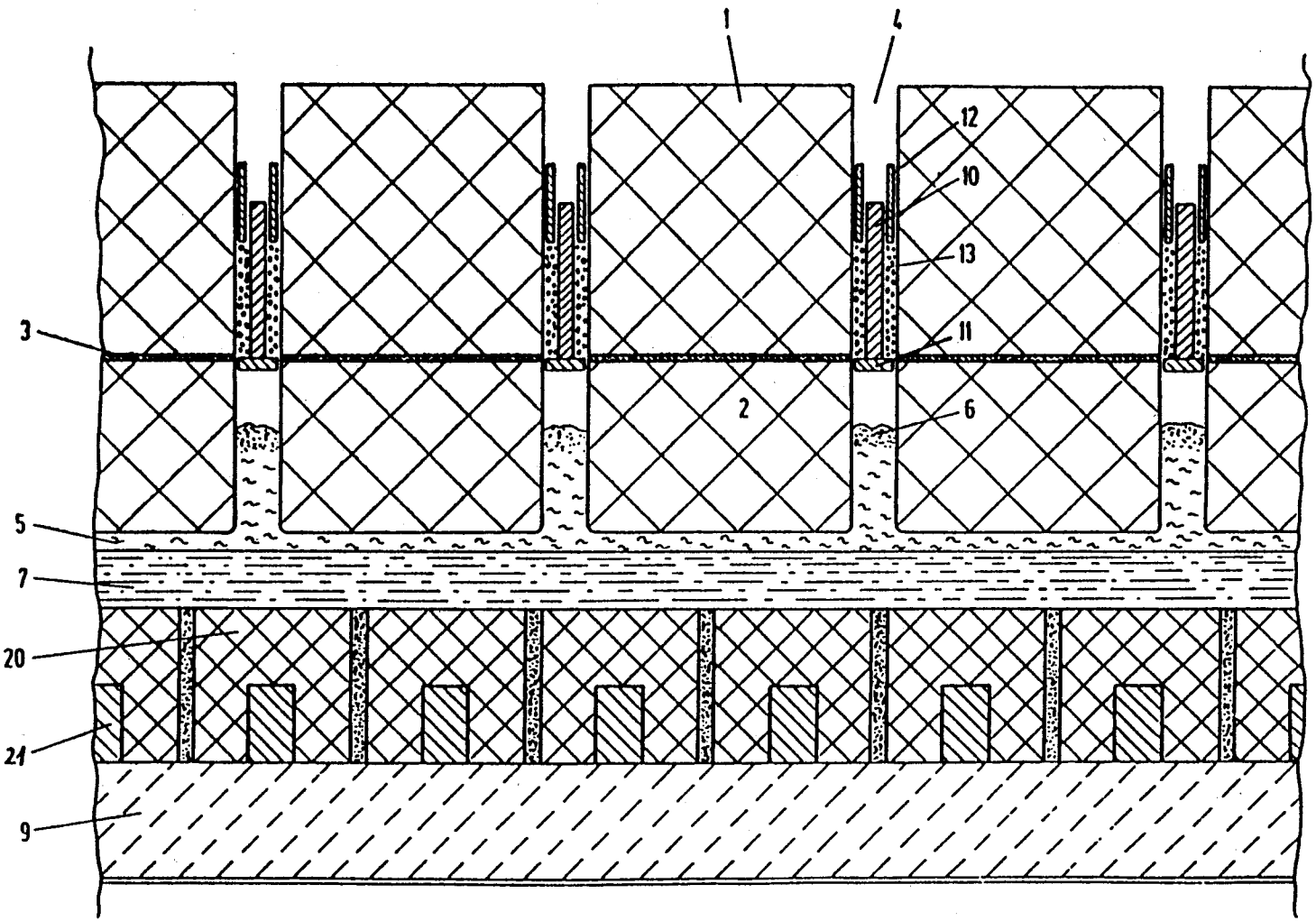
FIG. 1 shows a section from the middle part of the electrolysis cell in longitudinal section and employing a conventional flat cathode and continuous anodes which are physically and electrically joined by a compressed granulate packing according to the invention.
Figure 2:
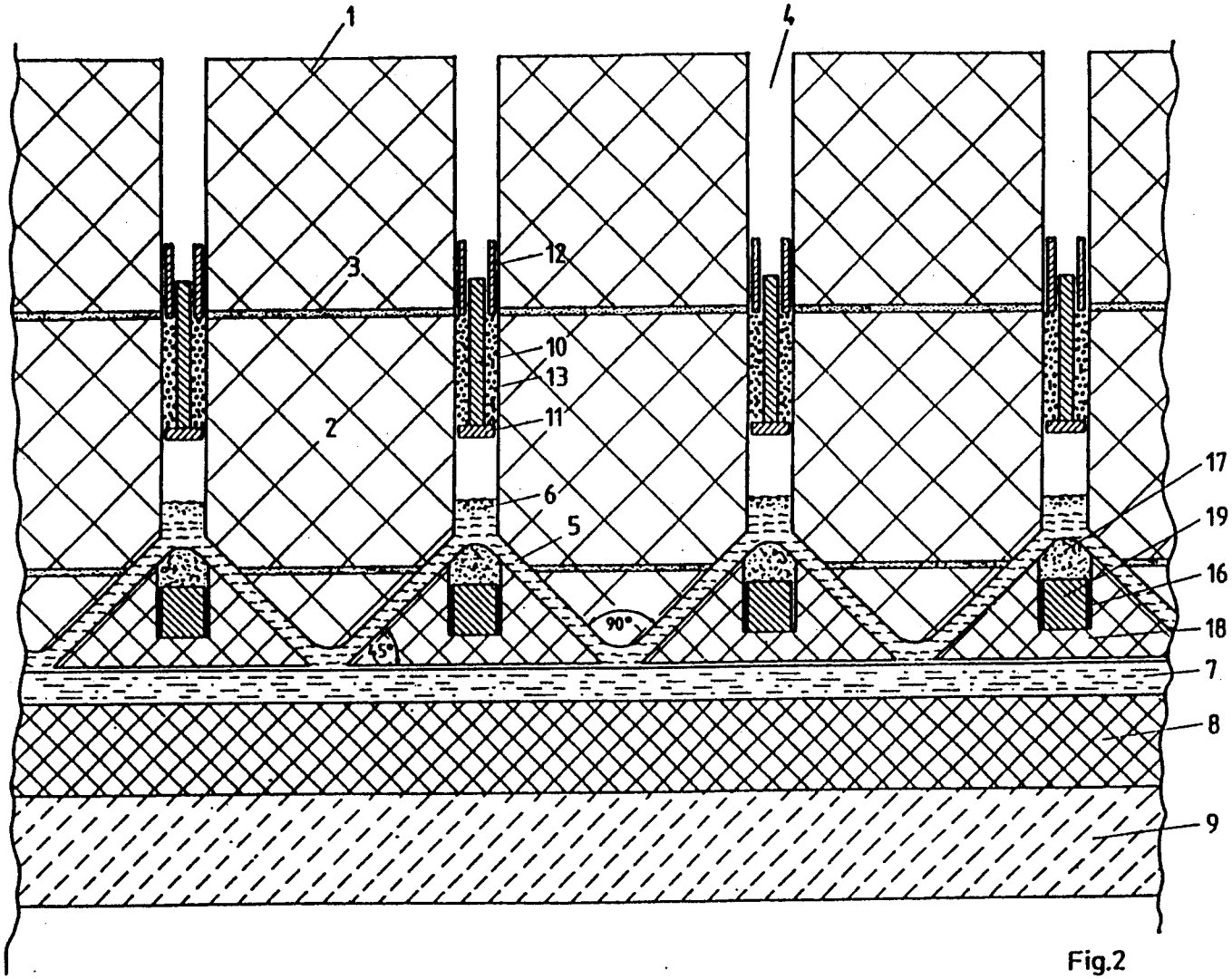
FIG. 2 represents a partial region similar to that of FIG. 1, however with a novel, surface enlarging design of the cathode.

The anode block package and 2 dips into the electrolysis bath or into the electrolyte melt 5. The immersed, electrolytically active part of the anode package assumes a surface shape similar to that of the opposite cathode. In FIG. 1, the aluminum bath forms a horizontal, flat, cathode surface. FIGS. 2 and 3 show embodiments with enlarged, active surfaces of the anode blocks and a lower current density in the molten electrolyte 5. Within the electrolysis bath in FIG. 2, anode cross sectional profiles with a coned point of 90° and a corresponding angle of slope of 45° have been provided. In FIG. 3, these angles are 60°. It follows from this that the current density in the electrolyte is reduced by a factor of $\sqrt{2}=1.4$ in the embodiment of FIG. 2 and by a factor of 2 in the embodiment of FIG. 3, compared with the embodiment of FIG. 1. Other angular cross sectional profiles having an angle of slope may be employed. The bath of the molten electrolyte is 20 to 25 cm deeper in the example of FIG. 2 and 40 to 45 cm deeper in the example of FIG. 3 than in the case of a level, flat, known cathode of FIG. 1. In FIG. 1, the layer 7 of liquid aluminum resides on the cathode blocks 20. On the other hand, in FIGS. 2 and 3, the layer 7 of liquid aluminum is below the cathode blocks 14 and 18 on the carboceramic bottom 8. The thermal insulation 9 adjoins below the cathode blocks 20 in FIG. 1 or below the bottom 8 in FIGS. 2 and 3.

The cathode blocks 14 and 18 in FIGS. 3 and 2 have triangular cross sections with the angles given in the Figures. With respect to FIG. 3, a rectangular, longitudinal groove (or slot) 16, in which a steel bar 15, which is referred to as cathode collector bar in the art, is embedded for current leakage, is molded or machined from above into the cathode block 14 with the profiled cross section of an equilateral triangle. The cathode collector bar 15 is embedded in the groove either by casting cast iron or also by ramming in a carbon composition with a good electrical conductivity. The groove space above the cathode collector bar 15 is filled up with a stamping or ramming composition on a carbon or graphite basis that is consolidated by coking the binder. The graphite blocks 14, 18 and 20 are made from conventional, commercial electrode raw materials for these products, e.g., electrically-calcined anthracite admixed in various proportions with electrographite or pure graphite. The addition of refractory carbides, nitrides or borides to the carbon materials, which can increase wear resistance and electrical conductivity, is preferred. It can be seen from FIGS. 3 and 2 that the cathode blocks 14 and 18 are surrounded by electrolyte melt. There is an intervening space between the cathode blocks and the anode blocks which, in operation, is filled with electrolyte melt. The resistance heat produced in the cathode block 14, in the steel collector bar 15 and in the transition between the collector bar and the block remains exclusively in the electrolysis space. Moreover, because of advantageous current distribution and short current paths, the voltage drops between the active, inclined cathode surfaces and the current leaking cathode collector bar is less than in conventional cathode constructions, as, for example, in the embodiment of FIG. 1, so that savings totalling 0.5 kWh/kg of aluminum can be achieved for the electrolysis process. (FIG. 1 shows a cross-section of a conventional arrangement of the cathode region, but with an anode superstructure according to the invention.)

The aluminum, deposited on the inclined cathode surfaces, flows into aluminum bath 7 below the cathode blocks. This aluminum bath 7 is not affected by the current flow, so that electrodynamic forces produced by interactions with the strong magnetic fields are not a factor. Moreover, the aluminum in the collecting basin below the cathodes, with its dissolving action, cannot reach the cathode iron 15 and 19.

The carbon-containing lining 8 in FIGS. 2 and 3 protects thermal insulation 9 against penetration by aluminum and components of the electrolyte melt 5. Since the lining layer 8 does not have to be electrically conductive, dense composites of carbon, oxides and carbides (e.g., carbon-based bricks or blocks with added aluminum or $\beta$-SiC-bond), which ensure a greater imperviousness and thermal insulation, can advantageously be used for it. The refractory lining with the layers 8 and 9 offers a better, more constant heat protection and a longer service life than the known combination of a carbon bottom, through which current is flowing and below which thermal insulation is installed.

Figure 4:
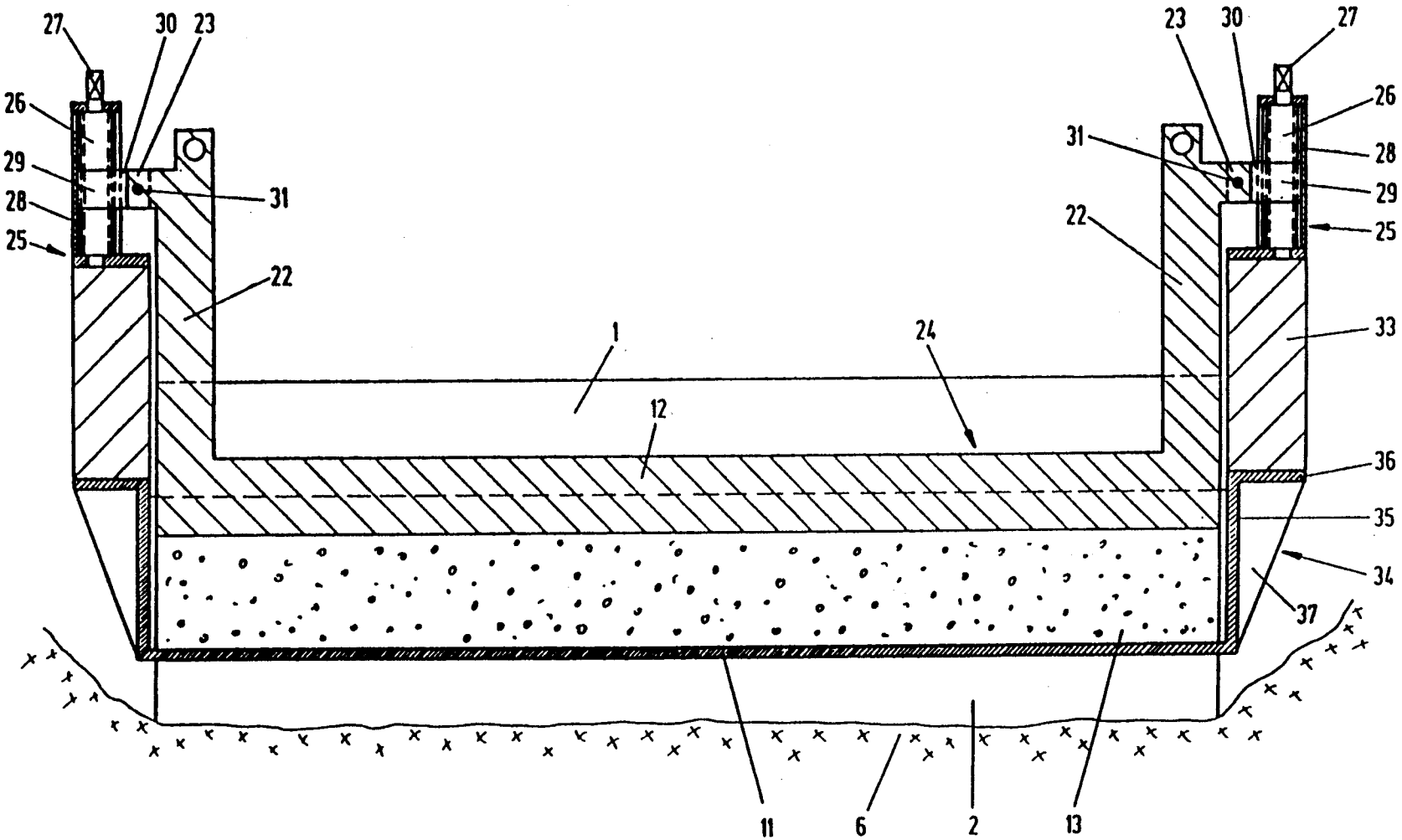
FIG. 4 relates to the anodic portion of the electrolysis cell and is a section along the line AB in FIG. 3.

FIG. 4 shows a section (see sectional line AB in FIG. 3) through the compressing girder 12 and the graphite grain packing 13. The compressing girder 12 has vertical supports 22 on both sides, at the upper ends of which brackets 23 with a hole, which extend over the anode beam 33, are mounted. The structural part, comprising compressing girder 12, vertical support 22 and bracket 23 is collectively referred to as clamping clip 24. The pressure and tension acting on the clamping clip 24 is exerted by a spindle socket 25, which is mounted on the anode beam 33. The spindle socket 25 contains the spindle 26, which can be operated or turned by the ratchet head adapter 27. The cylindrical nut 29 with the bracket 30 with hole is seated on the spindle 26. The function of the guide bushing 28 is to precisely guide the cylindrical nut 29. The guide bushing 28 has a longitudinal slot, in which the bracket 30 with hole moves up and down when the spindle 26 is turned. The bracket 23 of the clamping clip 24 and the bracket 30 of the cylindrical nut 29 are connected to one another by the bolt 31 (in this connection, see also FIG. 7). The clamping clip 24 and the graphite grain packing 13 is put under pressure by simultaneously operating the right and left spindles 26, for example, by means of an impact wrench. After the pressure is relieved and the connecting bolts 31 are drawn, each clamping clip 24 can be removed individually. At any time during the operation of the cell, for example, in the event of malfunction, any anode block package can also be lifted out after the pressure on the clamping clip 24 is relieved.

If the narrow space between the cross connector 10 and the anode block 1 or 2 is to be refilled with graphite granulation 13, the compression girder 12 is run up above the upper edge of the cross connector 10. It is then possible to feed the graphite granulation 13 through a tubular lance from above into the contact band in the channel 4. The refilling with graphite granulation 13 is conducted as required and is combined with the shifting of an anode package into one operation.

The side enclosure of the anode blocks is evident from FIG. 4. The side border consists in the upper region of the anode beam 33 and in the lower region of the anode frame 34, which is composed of the frame wall 35 and console 36. Anode beam 33 and console 36 are bolted together to ensure good electrical conductivity. Gusset plates 37 are welded at intervals to the anode frame 34 to reinforce it. The cross connectors 10 are fastened to the inside of the frame wall 34. For this purpose a detachable connection by means of hexagonal screws is also preferred.

The electrolysis current wends its way from the anode beam 33 of aluminum over the thick-walled anode frame 34 of steel to the cross connectors 10, and from there over the graphite grain packings 13 into the anode block packages. A smaller, partial current can flow directly from the anode beam 33 to the cross connector 10 over the guide strip 32, which is welded at the lower end to the cross connector 10 and bolted in the upper part to the anode beam (in this connection, see FIGS. 7 and 8). The clamping clip 24 can also transfer current from the anode beam 33 to the graphite grain packing 13.

Figure 5:
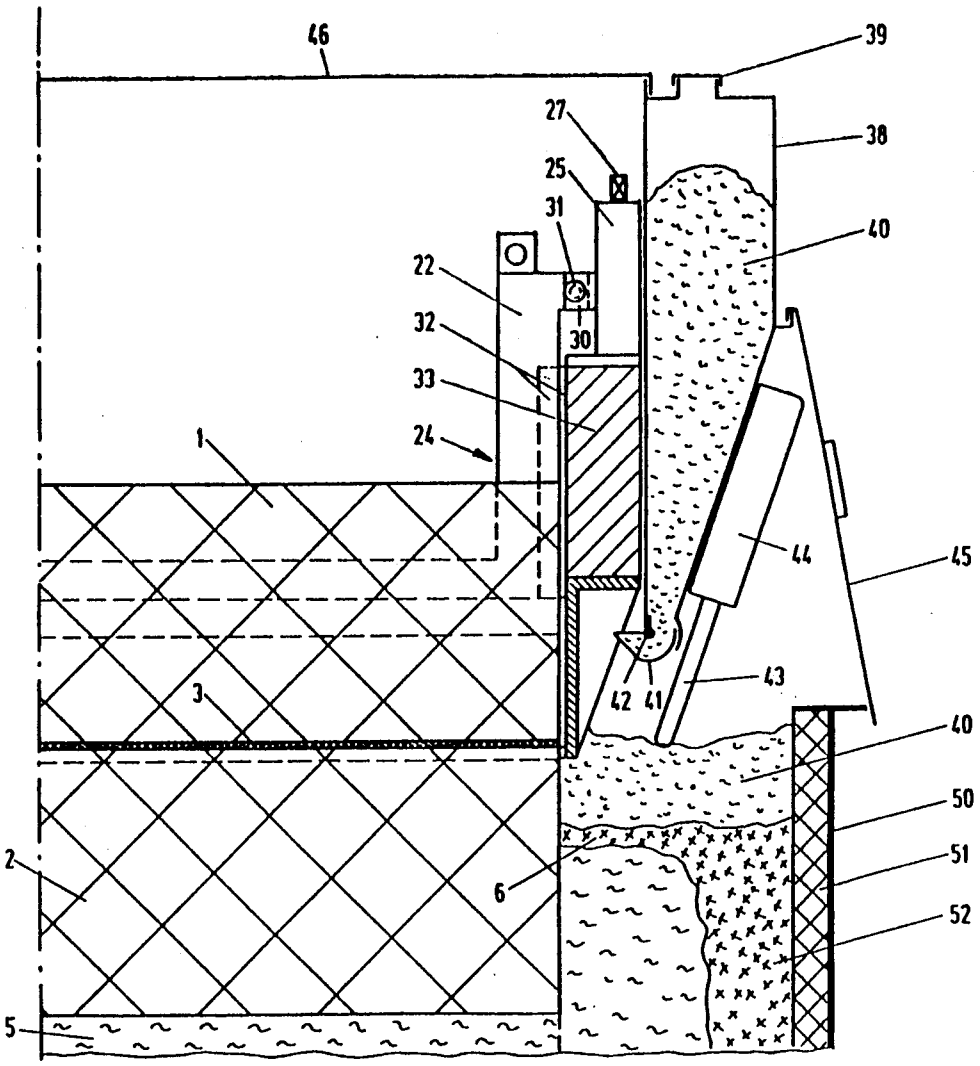
FIG. 5 is a section along the line CD in FIG. 3, and, moreover, up to the axis of symmetry of the cell. Detail of the side of the electrolysis cell is shown.

The side part of the electrolysis cell, which is shown as a sectional representation in FIG. 5, shows the charging apparatus for the aluminum oxide in a simplified sketch. The sketch shows a selected side portion of cross-section C.D shown in FIG. 3. The breaking and metering apparatus, which is sketched in FIG. 5, is primarily intended to elucidate the inventive principle. The breaking ram 43, which breaks through the covering crust 6 and makes a hole for supplying aluminum oxide, receives its impact thrust from a pneumatic cylinder 44, which is mounted on the stationary steel box 38. The steel box 38 bridges the whole length of the electrolysis cell, rests at the ends on two supporting constructions and functions as a storage and charging container for the aluminum oxide 40. The steel box 38 can also accommodate fluxes, such as aluminum fluoride, in divided chambers (not shown). The discharging shutter 41 for the aluminum oxide is installed at the lower end of the steel box 38. When the rocker shaft 42 is activated, the aluminum oxide runs out of the discharging shutter 41. At the same time, addition of aluminum oxide from the steel box 38 is prevented. The frequency and the amount of the metered addition of oxide is governed automatically by a remote-controlled system.

Instead of stationary breaking tools, mobile breaking cylinders with breaking chisels may also be provided, which can be moved along the whole of the side front and can carry out the breaking process and which may be computer-controlled. A variation of servicing the whole side front and supplying it with aluminum oxide includes a continuous breaking sword with breaking thorns.

Steel box 38 is filled with aluminum oxide 40 over pipe socket 39, which can also be a part of the oxide distribution system. The side space of the electrolysis cell is lined towards the outside by the suspendable aluminum sheet gates 45. At the front side, the electrolysis cell is shielded towards the outer space by similar aluminum sheet panels 47 (see FIG. 6). At the top, the whole of the anode space is covered by the horizontal gates 46.

The lower right field of FIG. 5 illustrates a section of the vat lining of the electrolysis cell. The steel wall 50 of the electrolysis vat is protected by a cryolite and aluminum-resistant side-wall plate 51. In front of the edge plate 51, a thick crust 52 of aluminum oxide-rich, solidified electrolyte melt forms as effective frontal protection against the electrolysis bath 5.

Figure 6:
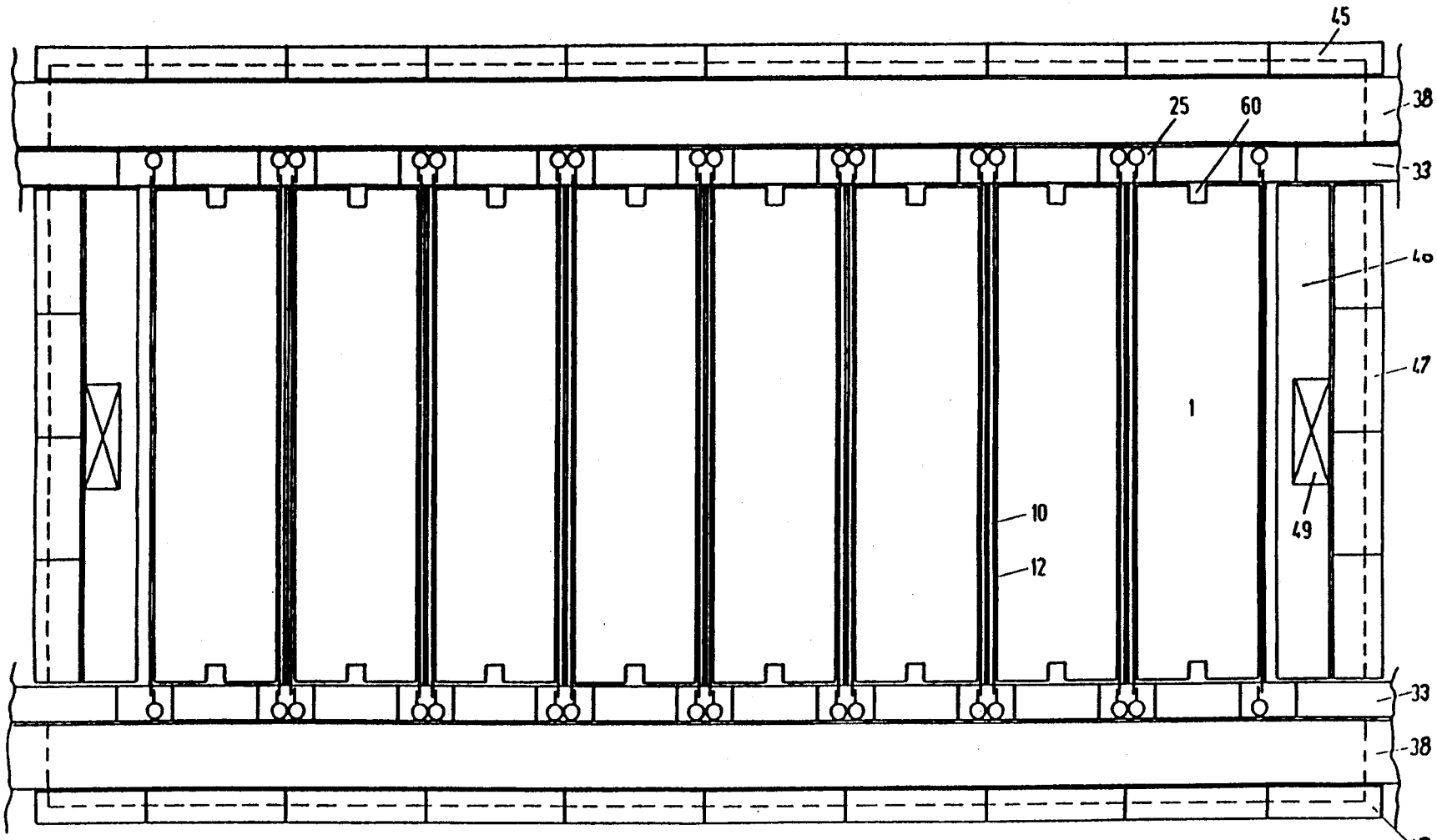
FIG. 6 is a plan view of the electrolysis cell, however, without the front-side furnace heads with the supporting structures and the lifting devices.
Figure 7:
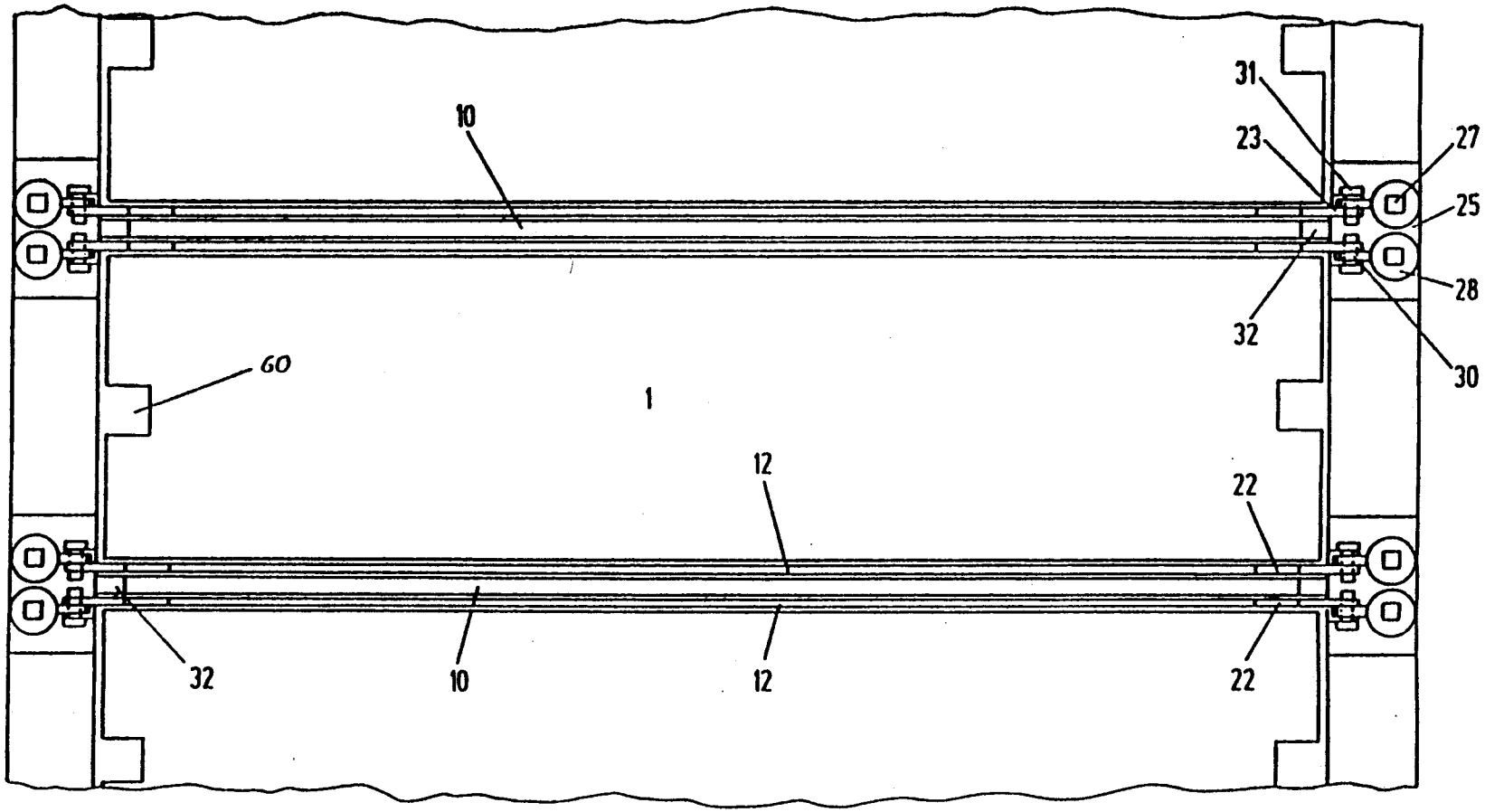
FIG. 7 is an enlarged partial region of the plan view of FIG. 6.

Exhaust of waste gas from the anode from the electrolysis cell may be explained by the plan view of the electrolysis cell of FIG. 6. At the front ends of the electrolysis, there are, in close connection with the anode blocks 1, two hollow boxes, which are U-shaped in the downwards direction and open and closed off towards the top by the covering sheet metal 28. Duct connection 49 leads from covering sheet metal 48 to the waste gas line. Removable sheet metal panels 47 are suspended as gates at the hollow box below the covering sheet metal 48. It can be seen from FIGS. 5 and 6 that the superstructure of the electrolysis cell is tightly sealed and that, under normal operating conditions, no dust or waste gas can escape to the surroundings. FIG. 7 illustrates once more how the upper construction of the electrolysis cell, that is, the arrangement of and the current supply to the anodes, is used to seal the anode-covered surface of the electrolysis bath in the upwards direction. Moreover, horizontally movable sheet metal gates 46 can be provided above the anode field as a further precaution for collecting the waste gases. The supporting construction at the ends of the electrolysis cell, which carries the anode superstructure, has not been drawn.

Figure 8:
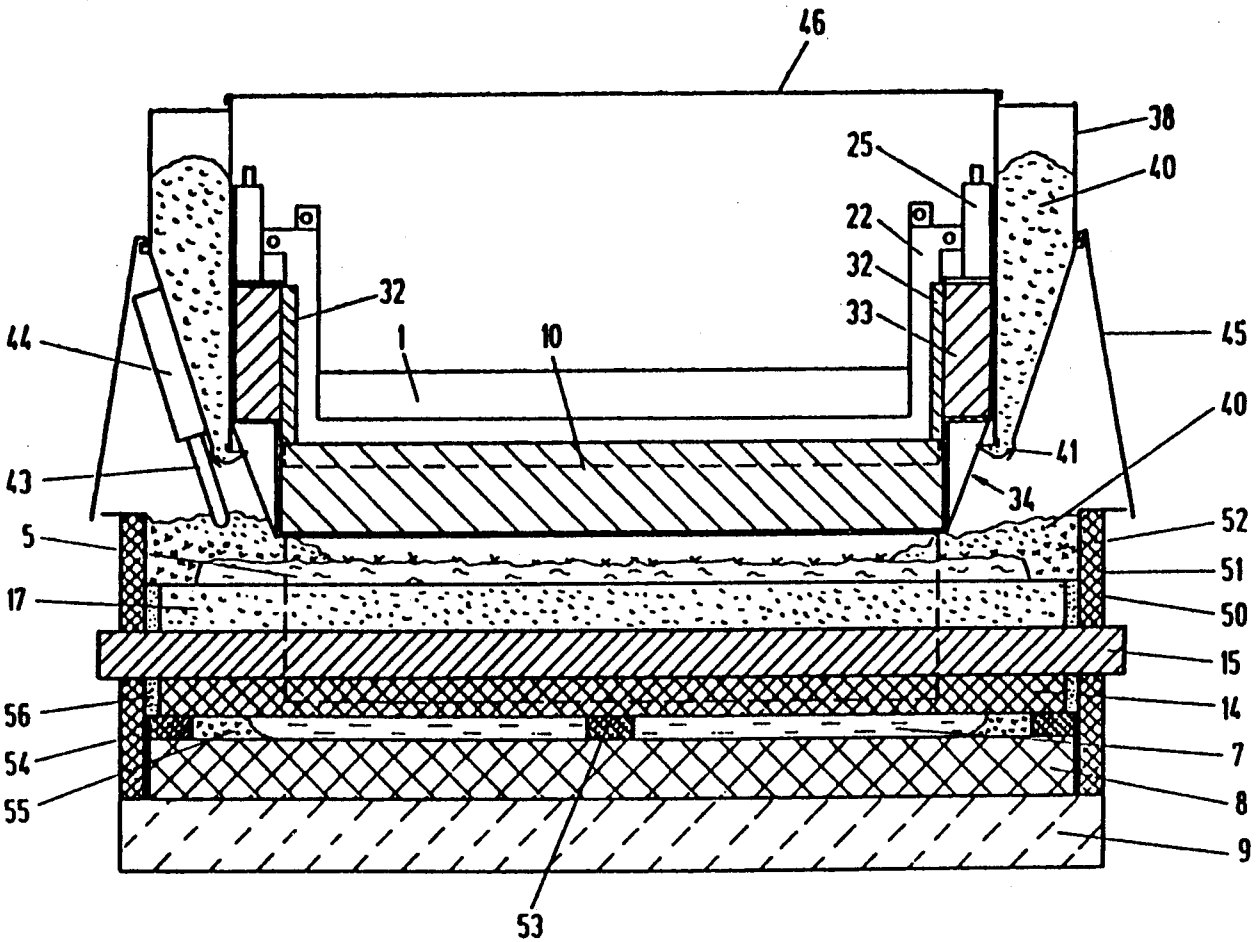
FIG. 8 is the electrolysis cell of FIG. 3 and section EF with omission of the various details sketched in the total cross section.

Some remaining details from the cathode region are explained in the overall cross-sectional picture in FIG. 8 (section EF in FIG. 3). Cathode block 14 with embedded steel bar 15 rests on carbon or graphite bases 53 and 54 disposed in the center and at the side. Bottom crust 55 forms starting from the side bases 54. The edge gap between cathode block 14 and edge plate 15 is rammed with a carbon-containing composition 56 (e.g., common carbon ramming paste based on electrically-calcined anthracite and a low softening pitch binder).

The interpolar distance between the anode and cathode is adjusted and controlled in a known manner, and depends on cell voltage. The distance is controlled by actuating the lifting spindles, at which the box-shaped unit of anode beams 33 and anode frame 34 is suspended. At intervals, which depend on the consumption of the carbon anode, the unit of anode beam and anode frame must be raised relative to the anode block package. The lowering and rasing of the anode frame takes place within limits of 10 to 20 cm, although the exact limits will depend upon the actual application.

In order to bring about this relative vertical shift between the anode blocks and the anode frame carrying them, an auxiliary jacking bridge is used, from which the anode block package is temporarily suspended. The auxiliary bridge is not depicted in the drawing, but is generally described below in sufficient detail to appraise those of ordinary skill in the art of its workings. The auxiliary bridge has vertically disposed holding arms which are lowered into the rectangular vertical grooves 60 (see FIGS. 6 and 7) of the anode blocks 1 up to about 20 cm above the electrolysis bath during or after the setting down of the auxiliary bridge. The holding arm includes a stationary U-profile, the lower end of which is wedge-shaped, and a movable, rectangular rod, which at its lower end has a wedge shoe, which nestles up against the sloping legs of the U profile. The holding arm is clamped at the lower end in the anode groove 60 by pulling up the rectangular rod by hydraulic means. A back toothing on the wedge shoe at the rectangular rod as well as on the lower end of the U profile ensures that the holding arm is seated in the anode groove 60 without slipping. All clamping clips 24, by means of which the graphite granulation is pressed, are loosened by means of the spindle sockets 25 and, under sliding current contact, the combination of anode beam and anode frame is raised as one piece. Subsequently, the clamping clips 24 are tightened once again, the holding lances of the auxiliary bridge are loosened and the auxiliary bridge is taken down by an overhead crane (not shown) and removed. In order to carry out the shifting of the anode frame in, as far as possible, small increments, and, therefore, quite frequently, to maintain short current paths and save energy, it may be advisable to automate the loosening and tightening of the clamping clips 24. This can be done, for example, by connecting all spindles 26 over suitable drive wheels and couplings to a common, motor driven shaft, which can rotate in either direction. A jacking frame with holding arms similar to those described above is used in order to be able to lift individual anode block packages out in the event of a malfunction.

An alternate method of raising the contact devices and the assembly of anode beams and frame relative to the anode packages consists of pressing the anode packages by means of strong hydraulic cylinders downward, while lifting the assembly of anode beams and frame simultaneously with the same speed over the same distance.

LIST OF REFERENCE SYMBOLS

1=upper anode block
2=lower anode block
2=adhesive cement layer (gluing paste layer)
4=lane between the anode blocks
5=electrolyte melt
6=bath crust
7=aluminum bath, aluminum layer
8=carboceramic bottom under the aluminum bath
9=bottom thermal insulation
10=cross connector between anode blocks in the channel 4
11=flange of the cross connectors
12=compression girder on the graphite granulation
13=graphite grain packing 14=cathode block, equilateral triangle profile, 60°
15=cathode collector bar in 60° block
16=groove in cathode block for cathode steel bar
17=carbon stamping composition for cathode steel bar
18=cathode block, angle 90° and 45° (FIG. 2)
19=cathode collector bar in cathode block 90°/45° (FIG. 2)
20=cathode bottom (in FIG. 1)
21=cathode collector bar (cathode steel bar)
22=vertical support for the clamping clip
23=bracket with hole at clamping clip or at the vertical support 22
24=clamping clip for graphite grain packing
25=spindle socket
26=spindle in the spindle socket 25
27=ratchet head adapter at spindle 26
28=sliding, guiding lining of the spindle socket 25
29=cylindrical nut on spindle 26
30=bracket with hole at the cylindrical nut 29
31=connecting bolt between bracket 23 and bracket 30
32=square vertical guide strip on the cross connector 10 at the anode frame
33=anode beam
34=anode frame
35=frame wall
36=console for anode beam
37=gusset plate as reinforcement
38=aluminum oxide box
39=pipe filling socket for aluminum oxide
40=aluminum oxide
41=discharging shutter for aluminum oxide
42=rocker shaft for aluminum oxide shutter
43=breaking ram
44=pneumatic cylinder
45=lateral, suspendable gates
46=movable, horizontal gates over the anode space
47=suspension plates at the front sides of the electrolysis cells
48=covering sheet metal for the front ends
49=gas exhaust duct (connection)
50=wall of the steel vat
51=rim or side-wall plate
52=edge crust
53=central base under the cathode block
54=side base under the cathode block
55=bottom crust in front of the side base 54
56=carbon-containing composition in the gap between the cathode block and the edge plate
60=rectangular vertical groove in the anode blocks at the front ends

What is claimed is:

1. An electrolysis cell for the fusion electrolytic extraction of aluminum comprising:

a) a cell housing;

b) a plurality of anode blocks having longitudinal and front sides and a lower surface;

c) cross-connecting means for physically connecting said blocks along said longitudinal sides and providing a packing receiving channel therebetween, each said cross-connecting means attached to an upper part of the cell housing;

d) granulate packing of carbon-containing material packed into said channels, said packing and cross-connecting means physically and electrically joining the anode blocks;

e) a plurality of cathode blocks, each said cathode block having an upper surface facing the lower surface of a corresponding anode block; and f) means for maintaining an intervening space between the facing surfaces of said anode block and said cathode block.

2. The electrolysis cell of claim 1, wherein the cross-connecting means and the granulate packing extend over the entire length of each longitudinal side of each individual anode block.

3. The electrolysis cell of claim 1, wherein said granulate is a coarsely grained, binder-free material selected from the group consisting of graphite, electrographite, coke, oil coke, tar coke, anode block residues and mixtures thereof.

4. The electrolysis cell of claim 1, wherein said cross-connecting means comprises a cross connector parallely disposed adjacent to the longitudinal side of each anode block with an intervening gap between the cross connector and the anode blocks, a flange perpendicularly connected to the lower end of said connector, and compression girders disposed between the cross connector and at least one adjacent anode block, said compression girder disposed sufficiently above said flange to provide said receiving channel, and said cell further comprising means for disposing said compression girders between the cross connector and adjacent anode block.

5. The electrolysis cell of claim 4, further comprising an anode frame for rigidly supporting said anode blocks, said frame being connected to the cell housing and each cross connector being connected to the anode beam and thereby attached to the cell casing.

6. The electrolysis cell of claim 5, further comprising a plurality of spindle sockets attached to said anode beam and to each compression girder, the spindle sockets providing a means of moving the compression girders to compress the packing.

7. The electrolysis cell of claim 6, wherein the compression girders compress said packing to a specific pressure between about 150 and 300 $N/cm^2$.

8. The electrolysis cell of claim 5, wherein the combination of said anode frame, said cross-connecting means, said anode blocks and the cell housing cover said cathode blocks and said intervening space between the anode and cathode blocks in a substantially gas-tight manner.

9. The electrolysis cell of claim 1, further comprising means for compressing said packing and wherein the specific pressure on the packing is between about 150 to 300 $N/cm^2$.

10. The electrolysis cell of claim 1, wherein each anode block includes a vertical U-shaped groove on each lateral side.

11. The electrolysis cell of claim 1, further comprising means for disposing said cathode blocks relative to one another and to the cell bottom, wherein the cathode blocks are disposed at a distance from one another and at a distance from the bottom lining of the cell, the space so formed beneath the cathode blocks providing a collecting basin for aluminum, and said cathode blocks upper surfaces being sloped and disposed facing the anode blocks such that aluminum formed during electrolysis drains to the collecting basin.

12. The electrolysis cell of claim 11, wherein the cell is encased completely by metal cladding.

13. The electrolysis cell of claim 12, further comprising charging means for dispensing aluminum oxide at the front sides of the anode blocks, said dispensing means positioned within said metal cladding of the cell.

14. The electrolysis cell of claim 11, wherein the upper surface of each said cathode block is roof shaped or half-barrel shaped and its underside is disposed in a plane above the cell bottom lining, and wherein gaps, through which the deposited aluminum can flow off into the collection space below the cathode blocks, remain between the adjacent cathode blocks.

15. The electrolysis cell of claim 14, wherein each cathode block has an approximately triangular cross section.

16. The electrolysis cell of claim 15, wherein the angle of slope of the upper surface of each cathode block is at least 45° relative to the cell bottom.

17. The electrolysis cell of claim 14, further comprising longitudinal grooves in the upper part of each cathode block and a plurality of cathode collector bars, said bars disposed in said longitudinal grooves.

18. The electrolysis cell of claim 14, further comprising supporting bases disposed between the bottom of the cell and said cathode blocks and providing support for said cathode blocks.

19. The electrolysis cell of claim 1, further comprising a thermal insulative layer lining the upper side of the cell bottom and comprising composites of carbon, oxides or carbides.

20. The electrolysis cell of claim 19, further comprising a cryolite and aluminum-resistant layer lining the upper side of said insulative layer.

21. An electrolysis cell for the fusion electrolytic extraction of aluminum, comprising:

a) a cell housing;

b) a plurality of anode blocks having longitudinal and front sides and a lower surface;

c) cross-connecting means for physically connecting said blocks, each said cross-connecting means attached to an upper part of the cell housing;

d) a plurality of cathode blocks, each said cathode block having an upper surface opposing the lower surface of a corresponding anode block, said upper surface having substantially triangular or semicircular cross-section, wherein the cathode blocks are disposed at a distance from one another and at a distance from the bottom lining of the cell, the space so formed beneath the cathode blocks providing a collecting basin for aluminum, and wherein the slope and disposition of said cathode blocks is such that aluminum formed during electrolysis drains to the collecting basin;

e) means for disposing said cathode blocks relative to one another and for maintaining a space between said cathode blocks and the cell bottom; and f) means for maintaining an intervening space between the opposing surfaces of said anode block and said cathode block.

22. The electrolysis cell of claim 21, wherein the underside of each cathode block is disposed in a plane above the cell bottom lining, and wherein gaps, through which the deposited aluminum can flow off into the collection space below the cathode blocks, remain between adjacent cathode blocks.

23. The electrolysis cell of claim 22, wherein each cathode block has an approximately triangular cross section.

24. The electrolysis cell of claim 23, wherein the angle of slope of the upper surface of each cathode block is at least 45° relative to the cell bottom.

25. The electrolysis cell of claim 22, further comprising longitudinal grooves in the upper part of each cathode block and a plurality of cathode collector bars, each of said bars disposed in said longitudinal grooves.

26. The electrolysis cell of claim 22, further comprising supporting bases disposed between the bottom of the cell and said cathode blocks and providing for support for said cathode blocks.

27. The electrolysis cell of claim 21, wherein the upper surface of each cathode block is substantially roof shaped or half-barrel shaped and its underside is disposed in a plane above the cell bottom lining, and wherein gaps, through which the deposited aluminum can flow off into the collection space below the cathode blocks, remain between adjacent cathode blocks.

28. The electrolysis cell of claim 27, wherein the angle of slope of the upper surface of each cathode block is at least 45° relative to the cell bottom.

29. A method for refurbishing the anode blocks of an electrolysis cell, comprising:

providing:

a) a cell housing;

b) a plurality of anode blocks having longitudinal and front sides and a lower surface;

c) cross-connecting means for physically connecting said blocks along said longitudinal sides and providing a packing receiving channel therebetween, each said cross-connecting means attached to an upper part of the cell housing;

d) granulate packing of carbon-containing material packed into said channels, said packing and cross-connecting means physically and electrically joining the anode blocks;

e) a plurality of cathode blocks, each said cathode block having an upper surface facing the lower surface of a corresponding anode block; and f) means for maintaining an intervening space between the facing surfaces of said anode block and said cathode block;

applying a layer of adhesive cement composition to the upper sides of an anode block in the cell; and placing a replacement anode block upon the adhesive layer.

30. The method of claim 29, wherein the combination of said anode frame, said cross-connecting means, said anode blocks and the cell housing cover said cathode blocks and said intervening space between the anode and cathode blocks in a substantially gas-tight manner, and further comprising the step of recommencing fusion electrolytic extraction of aluminum without substantial interruption or diminishment in the function of the refurbished anode block.

31. An electrolysis cell for the fusion electrolytic extraction of aluminum, comprising:

a) a cell housing;

b) a plurality of anode blocks having longitudinal and front sides and a lower surface;

c) an anode source;

d) electrical connecting means for electrically connecting said blocks to said anode source;

e) a plurality of cathode blocks, each said cathode block having upper surface opposing the lower surface of a corresponding anode block, wherein the cathode blocks are disposed at a distance from one another and at a distance from the bottom lining of the cell, the space so formed beneath the cathode blocks providing a collecting basin for aluminum, wherein said cathode block upper surface are sloped and disposed facing the anode blocks such that aluminum formed during electrolysis drains to the collecting basin, and wherein said cathode blocks are positioned such that their electrolytically-active upper surfaces interact in substantially all of the lower surfaces of the anode blocks and said electrolytically involved upper surfaces have at least about double the area of corresponding cathode blocks with a flat upper surfaces;

f) means for disposing said cathode blocks relative to one another and for maintaining a space between said cathode blocks and the cell bottom; and g) means for maintaining an intervening space between the opposing surfaces of said anode blocks and said cathode blocks.

32. The electrolysis cell of claim 31, wherein each cathode block has an approximately triangular cross section.

* * * * *